US005170462A

United States Patent [19]

Park

[11] Patent Number: 5,170,462

[45] Date of Patent: Dec. 8, 1992

[54] APPARATUS FOR SUPPLYING HEATED WATER TO A BIDET

[75] Inventor: Chan G. Park, Seoul, Rep. of Korea

[73] Assignee: Daewoo Electronics Co. Ltd., Seoul, Rep. of Korea

[21] Appl. No.: 604,512

[22] Filed: Oct. 29, 1990

[30] Foreign Application Priority Data

Oct. 28, 1989 [KR] Rep. of Korea ..... 89-15567

[51] Int. Cl.[5] ..... H05B 1/02; F24H 1/20; E03D 9/08; A47K 11/08

[52] U.S. Cl. ..... 392/492; 4/420.2; 4/443; 392/487

[58] Field of Search ..... 392/485-495; 4/420.2, 443

[56] References Cited

U.S. PATENT DOCUMENTS 3,947,899 4/1976 Robinson et al. ..... 4/420.2
4,062,071 12/1977 Blanquet ..... 4/420.2

FOREIGN PATENT DOCUMENTS 54-1946 1/1979 Japan ..... 4/420.2
1346839 1/1974 United Kingdom ..... 392/485
WO83/03273 7/1983 World Int. Prop. O. ..... 4/443

*Primary Examiner*—Anthony Bartis
*Attorney, Agent, or Firm*—Watson, Cole Grindle & Watson

[57] ABSTRACT

A cleaning water heating and supplying device comprises a tank that has a body and a cover and is divided by a partition into a heating zone in which an electric heater is provided and a reserving zone in which a detector for detecting the level of the water is provided. A water circulating pipe guides the heated water from the upper part of the heating zone to the lower part of the reserving zone and is located on the partition wall. A valve for controlling the water supply into the heating zone and a sensor for sensing the temperature of the heating zone are provided in communication with the heating zone. A discharge valve is provided in communication with the reserving zone. A lever which is controlled by a remote control cable to operate the valve and an associated switch is provided at the outside of the tank. The device promptly provides the required amount of heated water at the required temperature at any time.

9 Claims, 3 Drawing Sheets

APPARATUS FOR SUPPLYING HEATED WATER TO A BIDET

BACKGROUND OF THE INVENTION

This invention relates to a cleaning water heating and supplying device for use with a bidet capable of washing the user's anus or like body part, and more particularly, to a device used in association with the bidet for supplying a promptly heated water at a desired temperature.

One type of cleaning water heating device associated with a bidet is described in U.S. Pat. No. 4,450,596 by Marvin C. Cohen. This device discloses, however, a relatively long temperature-evening coil and complicated structure. This long coil may allow for dirt accumulation. Another type of cleaning water supplying device is described in U.S. Pat. No. 4,451,942 by Yoshio Hirano, et al. This device, since the heater is positioned outside the water tank, it is not adequate for prompt heating of the water and the heating efficiency is low.

SUMMARY OF THE INVENTION

The object of the present invention is to effectively solve the problem caused in the cleaning water heating device of the prior art, and the purpose of the present invention is to provide a cleaning water heating device with simple structure which can prevent the malfunction of the electric heater and the reversion of the polluted water and promptly provide the requried amount of heated water at a required temperature at the required time.

To this end, the present invention is characterized in that the inside of the tank is partitioned into a heating tank in which an electric heater is provided and a reserving tank in which a water level detector is provided, and in that a water supply valve and a temperature sensor are provided in communication with the heating tank. A discharge valve and a drain pipe are provided in communication with the reserving tank, and an operation lever which operates the water supply valve and an associated switch is provided at the outside of the tank in such a way that the operating lever can be remotely controlled through a remote cable.

BRIEF DESCRIPTION OF THE DRAWINGS

A preferred embodiment of the present invention will now be described in detail with reference to the accompanying drawings wherein.

DETAILED DESCRIPTION

Figure 1:
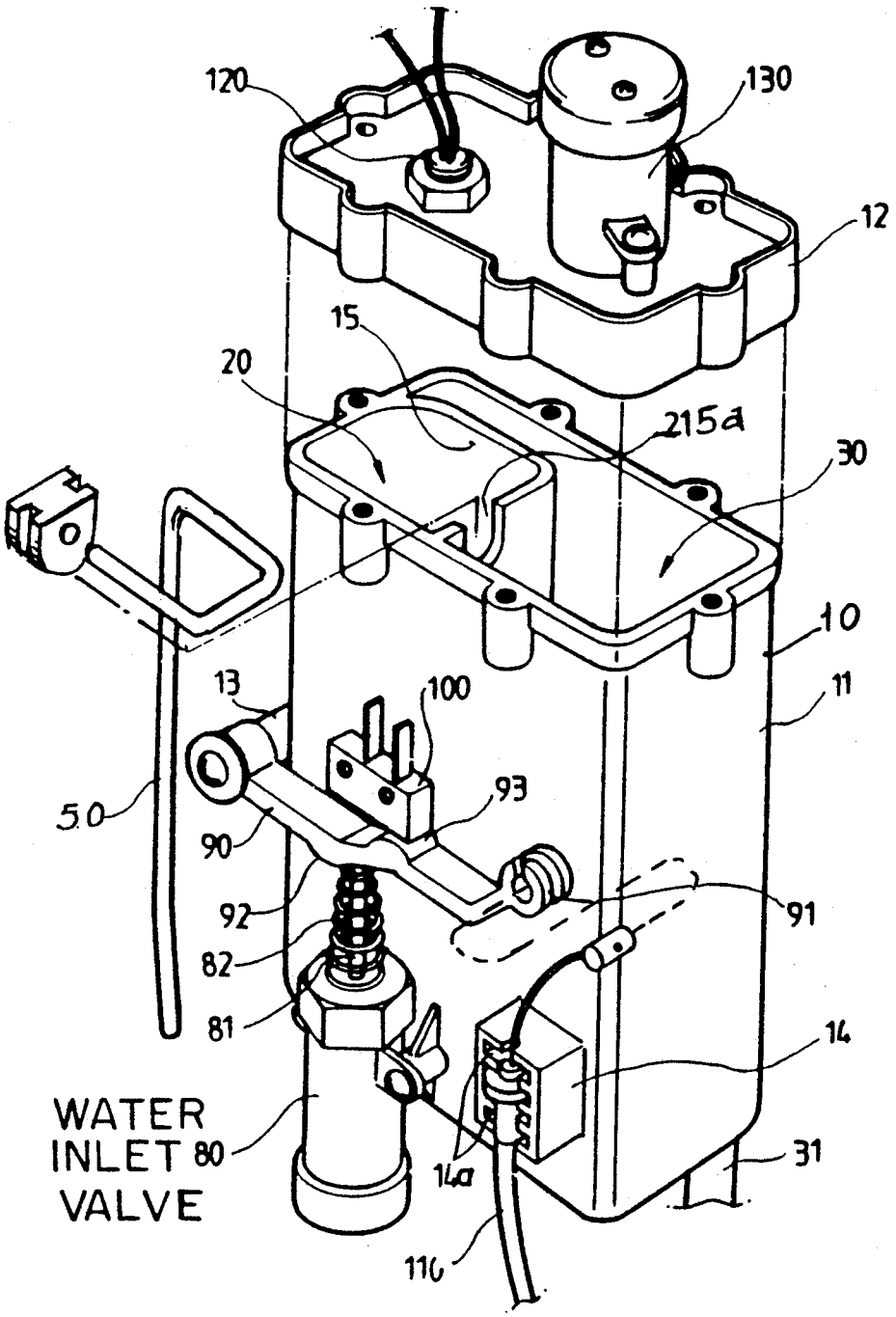
FIG. 1 is an exploded perspective view of an embodiment of the present invention.

In FIG. 1, 10 is a tank that comprises a box shaped body 11 and a plate shaped cover 12. A partition wall 15 is provided with a recess 15*a* at its upper end within body 11.

A sealing member 40 is provided with a groove 41 on its sides which fits into recess 15*a* of the partition 15, and a water circulating pipe 50 bent in a predetermined shape passes through the middle of the sealing member 40.

Figure 2:
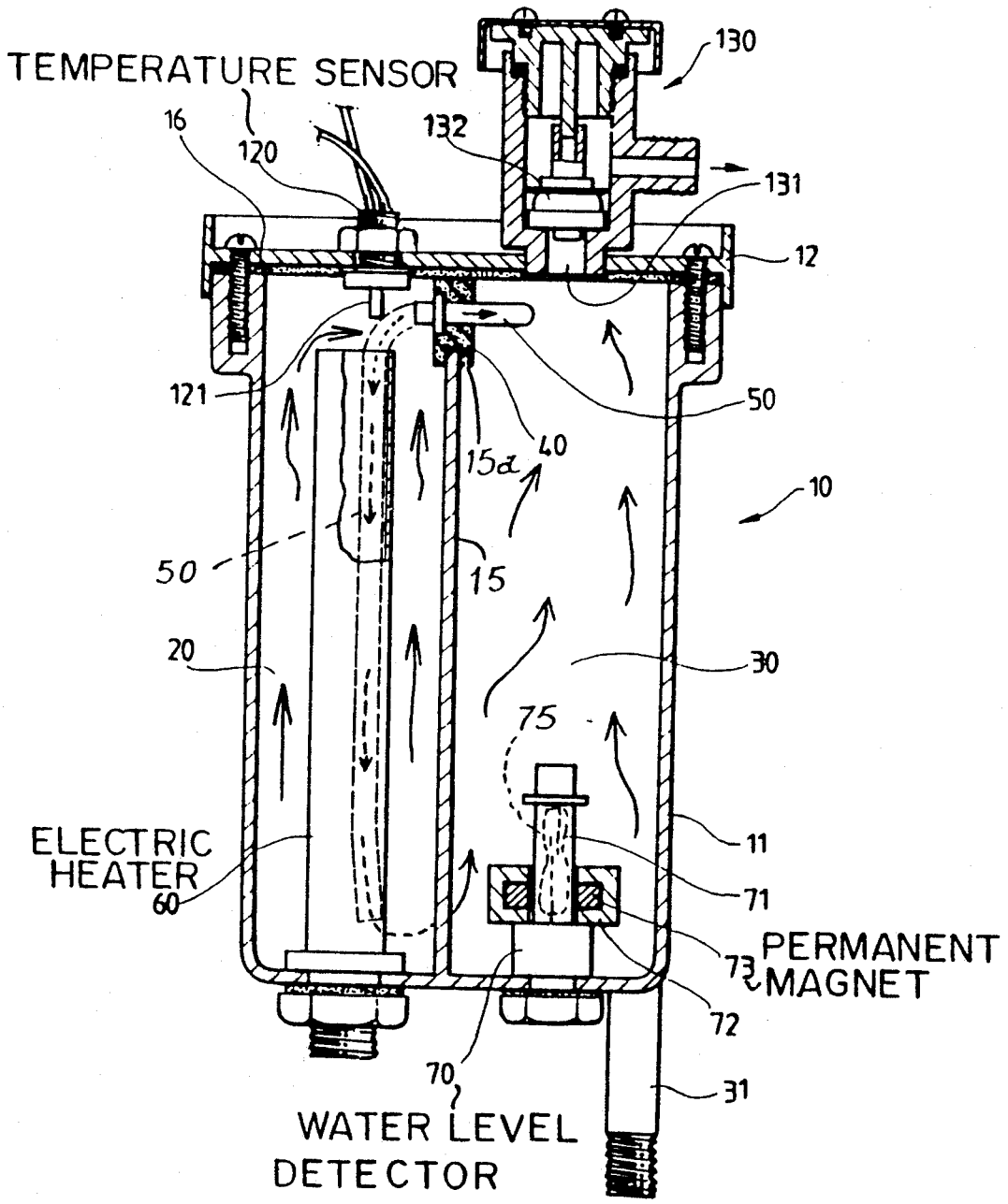
FIG. 2 is a longitudinal section of the embodiment shown in FIG. 1.

The cover 12 is mounted on top of the body 11 with a sealing member 16 disposed therebetween, as shown in FIG. 2. When this cover 12 is mounted on the body 11, a heating zone 20 is formed on one side of the partition 15 and a reserving zone 30 is formed on the other side.

One end of the circulating pipe 50 is located on the topside of the heating zone 20, and the remaining part of this pipe end passes through the sealing member 40 and wraps around the side of the partition 15 in the reserving zone 30. The other end of the pipe extends to the bottom of the reserving zone 30.

An electric heater 60 is provided in said heating zone 20 with its lower end being fixed on the bottom wall of the body 11 and its upper end being placed near to the upper end of the circulating pipe 50. A sensing rod 121 of a temperature sensor 120 for sensing the temperature of the heating zone 20 is also located near this pipe upper end and passes through the cover 12.

A water level detector 70 is provided at the bottom of the reserving zone 30. This detector is set up to be operated by a float 72 that moves up and down along a guide rod 71 in which a magnetic reed switch 75 is housed. In the float 72, a permanent magnet 73 is housed. A drain pipe 31 is connected to the bottom of the reserving zone 30 so that the water in the tank can be drained if necessary.

Referring to FIG. 1, a valve 80 for controlling the water supply into the heating zone 20 is provided on the lower side of the front of body 11 and this valve has in it a valve member (not shown) to increase or decrease the amount of the water supply through it. A spring 82 is provided around a rod 81 connected to the valve member and projecting from the valve 80, wherein the upper end of the rod 81 abuts on a downward projection 92 of a lever 90 that has a connector 91 for a remote control cable 110 on one end. The opposite end of the lever 90 is pivotally engaged to a boss 13 fixed to the body 11. An associated switch 100, such as a switch for the supply of heated air, is provided above the lever 90 in contact with an upward projection 93 of this lever so that the switch 100 can be operated by the upward projection 93.

The box 14 projecting from the front of the body 11 is provided for fixing and supporting a part of a remote control cable 110, and it has a plurality of recesses 14*a* in it for adjusting the tension of the remote control cable 110.

The temperature sensor 120 communicating with the heating zone 20 is provided to one side of the cover 12, and the tip of the sensing rod 121 projecting from this sensor 120 is to be placed near to the top of the electric heater 60. On the other side of the cover 12, a discharge hole 131 communicating with the reserving zone 30 and a valve 130 having a check 132 in it for closing or opening the discharge hole 131 are provided.

Figure 3:
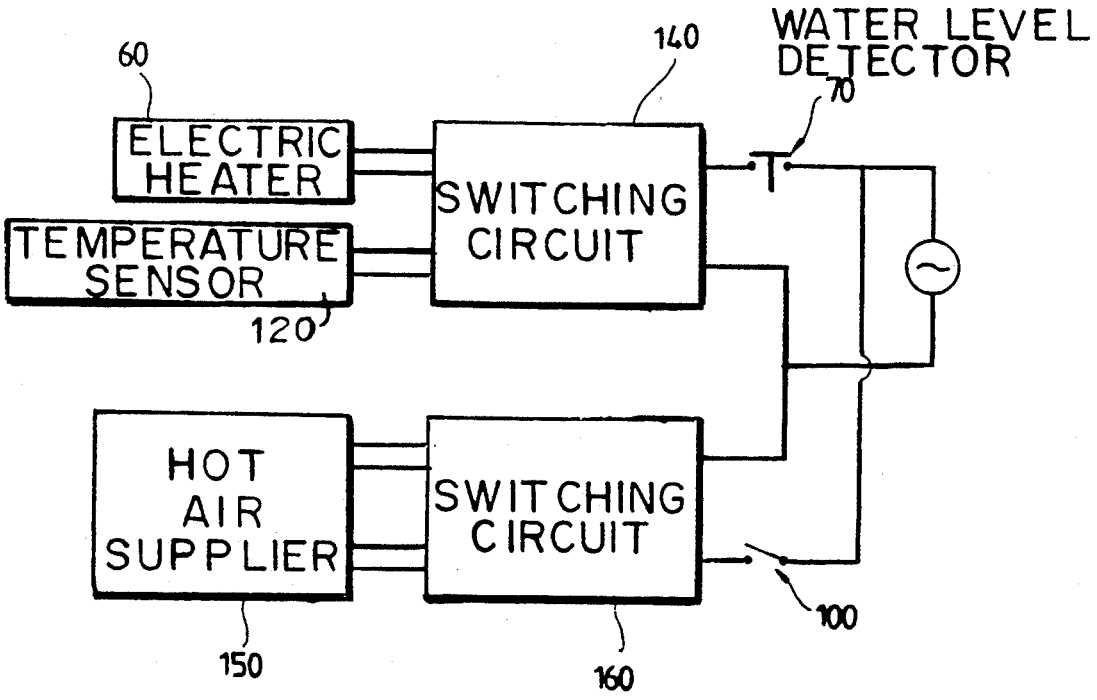
FIG. 3 is a circuit diagram of the embodiment shown in FIG. 1.

Referring to FIG. 3 showing an electric circuit diagram, the electric heater 60 and the temperature sensor 120 are connected to a switching circuit 140 which comprises a conventional triac, wherein the switch 70 is connected to an input end of the switching circuit 140. The other switch 100 associated with the supply of heated air is connected to the input end of another switching circuit 160 of an associated device 150 associated with the supply of heated air operated by an electric supply separate from the switching circuit 140.

FIG. 2 shows the assembled position of the above described components.

In operation, the water flows into the heating zone 20 through the valve 80 and is discharged into the reserving zone 30 via the water circulating pipe 50. The reserving zone 30 then discharges via the value 130 an amount of heated water equal to the amount flowing into it from the heating zone 20 to a certain external place where the water is to be used.

The process above described is carried out continuously while the water is supplied to the heating zone 20 through the valve 80 as the electric heater 60 operates and in this process the temperature sensor 120 continuously senses the temperature of the heating zone 20. If the temperature sensed by the sensor 120 is higher than the predetermined value, the operation of the electric heater 60 is temporarily stopped. Thus, water of the proper temperature is always discharged toward the reserving zone 30.

The temperature sensor 120 is in continuous operation to control the heater 60 even under the condition of suspension of the water supply into the tank 10 or the discharge of heater water from the tank 10, thereby the water reserved in the heating zone 20 as well as the reserving zone 30 is always maintained at suitable temperature. Thus, the user can be supplied with water of optimum temperature immediately from the beginning of use of the device.

Since the electric supply to the electric heater 60 is carried out from the lower side of heater 60, and since the cold water that flows into the heating zone 20 through the valve 80 flows in contact with the lower side of the heater 60, the connecting part of the heater 60 is prevented from being overheated. The efficiency of heating the supplied water is greatly increased because the cold water can be in sufficient contact with the surface of the electric heater 60 while it is heated and its level rises up in the heating zone 20.

Since the water circulating pipe 50 causes the water in the heating zone 20 to flow from the upper part of the heating zone 20 to the lower part of the reserving zone 30, the water from the heating zone 20 can be sufficiently mixed with the water remaining in the reserving zone 30, whereby the water in the heating zone 30 which may be overheated is not discharge directly to the user.

The tank's body 11 can be made of synthetic resin having a high heat resistance and a corresponding low thermal conductivity while the partition 15 is made of metal materials having a higher thermal condutivity, whereby an effect can be obtained that the temperature difference between the water in the heating zone 20 and the water in the reserving zone 30 is further reduced.

The control of the discharge rate of heated water can be effected by adjusting the open area inside of the valve 80 via the remote control cable 110 and the lever 90, etc.

Specifically, when the control cable 110 is pulled downwards, the lever 90 is rotated around the supporting point to the boss 13 in the right-handed direction, whereby the downwards projection 92 of the lever 90 pushes the rod 81 projecting from the valve member of the valve 80 to increase the water supply area so that more water can flow into the heating zone 20 and more heated water can be discharged from the reserving zone 30. To the contrary, if the control 110 is pushed upwards, the opening area in the valve 80 is reduced so that the supply rate to the heating zone 20 and the discharge rate of heated water from the reserving zone 30 can be reduced.

When the control cable 110 is pushed upwards to a predetermined position, the valve 80 is closed to halt the water supply and the disharge, and if the cable 11 is further pushed upwards from this position then the upwards projecting 93 of the lever 90 operates the switch 100 which is connected to the switching circuit 160 associated with the heated air supply operation so that the device 150 associated with the heated air supply can be operated.

The operating lever 90 is in a neutral position wherein the water supply valve 80 and, at the same time, the switch 100, is turned off by the force of the spring 82 when the device is not used.

On the other hand, the water level detector 70 provided on the bottom of the reserving tank 30 normally operates the switching circuit 140 when the reserving zone 30 is full with the water, i.e., when the float is raised to its top position. But when the reserving zone 30 is empty of the water, that is when the water level falls to a certain predetermined level because of some leakage of the water or some interruption of water supply, then the float 72 is lowered down to its bottom position to interrupt the electric supply to the switching circuit 140, whereby the operation of the electric heater 60 and the temperature sensor 120 is stopped.

In the case where the water in the reserving zone 30 is polluted use to some cause during the use of the device, the polluted water in the reserving zone 30 can be replaced with fresh water by opening the drain pipe 31 which is normally in the sealed state.

Now looking into the operation of the discharge valve 130, when the water flows into the reserving zone 30 from the heating zone 20 via the water circulating pipe 50, the internal pressure of the reserving tank 30 will be increased to raise the valve member 132 of the valve 130 so that the discharge hole 131 can be opened. As long as the water is supplied to the reserving zone 30 from the heating zone 20, the valve 130 remains opened so that the water in the reserving zone 30 can be continuously discharged to the user through it.

When the water is no longer supplied to the reserving zone from the heating zone 20 due to the interruption of the water supply, the internal preassure of the reserving zone 30 is decreased and then the valve member 132 of the valve 130 goes down to close the discharge hole 131 so that the external water can not flow adversely back into the tank 10.

As is understood from the above detailed description, the present invention provides an improved cleaning water heating device with which the various problems encountered heretofore in this art can be effectively solved. This device has the superior effect of preventing the adverse flow of the polluted water from outside, and of being protected by stopping the operation of its electric heater 60 and its temperature sensor 120 when the water dries up by detecting the condition of the water remaining in its reserving zone 30, and of supplying heated water of proper temperature immediately from the beginning of the use and constantly maintaining the water in the tank 10 at the proper temperature.

Although the present invention has been described in a specific embodiment, it will be appreciated by those skilled in the art that the above described preferred form has been made only by way of example and that numerous changes and modifications to the construction, combination and arrangement of the device can be made without departing from the spirit and the scope of the invention.

What is claimed is:

1. A cleaning water heating and supplying device comprising a tank which comprises a body having a removable cover, the interior of the tank being divided by a vertical partition into a heating zone in which an electric heater is provided and a reserving zone in which a water level detector is provided, a water circulating pipe arranged to guide the heated water from an upper part of said heating zone to a lower part of said reserving zone is provided on said partition, a supply valve for controlling the water supply into said heating zone and a temperature sensor for sensing the temperature of said heating zone are provided in communication with said heating zone, a drain pipe and a discharge check valve are provided in communication with said reserving zone, and a lever being movable in a first direction to open said supply valve and in a separate direction to close an associated switch through actuation of a remote control cable, said switch being arranged to initiate operation of a hot air supplier when the switch is closed.

2. A cleaning water heating and supplying device according to claim 1, wherein a recess is formed on top of said partition, and a sealing member is fit in said recess which is provided with an engaging groove on its sides in which the edges of the groove are seated and the middle of which is passed through by said water circulating pipe.

3. A cleaning water heating and supplying device according to claim 1, wherein said electric heater is engaged on the bottom wall of said body.

4. A cleaning water heating and supplying device according to claim 1, wherein said temperature sensor is provided to said cover so that the tip of an associated sensing rod thereof is placed near to the top of said electric heater.

5. A cleaning water heating and supplying device according to claim 1, wherein said discharge valve (130) is provided on one side of said cover.

6. A cleaning water heating and supplying device according to claim 1, wherein said water level detector (70) is provided on one side of the bottom wall of said body.

7. A cleaning water heating and supplying device according to claim 1, wherein said drain pipe is connected to a bottom of said reserving zone.

8. A cleaning water heating and supplying heating device according to claim 1, wherein said tank is made of synthetic resin having a specific thermal conductivity and said partition wall is made of a metal material of a higher thermal conductivity.

9. A cleaning water heating and supplying device according to claim 1, wherein a box having a plurality of recesses for adjusting the tension of the remote control cable, and projecting from a side of said body is provided for fixing and supporting one part of said cable.

* * * * *